US009930999B1

(12) United States Patent
De La Hoz

(10) Patent No.: US 9,930,999 B1
(45) Date of Patent: Apr. 3, 2018

(54) DISPOSABLE SINK COVER

(71) Applicant: Felipe De La Hoz, Miami Lakes, FL (US)

(72) Inventor: Felipe De La Hoz, Miami Lakes, FL (US)

( * ) Notice: Subject to any disclaimer, the term of this patent is extended or adjusted under 35 U.S.C. 154(b) by 0 days.

(21) Appl. No.: 15/284,649

(22) Filed: Oct. 4, 2016

(51) Int. Cl.
*A47K 1/06* (2006.01)
*E03C 1/186* (2006.01)
*E03C 1/264* (2006.01)

(52) U.S. Cl.
CPC ..... *A47K 1/06* (2013.01); *E03C 1/186* (2013.01); *E03C 1/264* (2013.01)

(58) Field of Classification Search
USPC ..... 4/654–657, 292
See application file for complete search history.

(56) References Cited

U.S. PATENT DOCUMENTS 2,817,851 A 12/1957 Barnwell
3,919,089 A * 11/1975 Gonzalez ..... B01D 29/05 210/445
4,351,073 A 9/1982 Elsas
7,685,654 B1 * 3/2010 Jones ..... A47K 1/06 4/655
7,951,292 B1 5/2011 de la Torre
9,080,322 B1 7/2015 Rodrigues
2007/0180610 A1 * 8/2007 Mohr ..... E03C 1/186 4/655
2010/0325791 A1 12/2010 Davidowitz
2016/0032573 A1 2/2016 Gavin

* cited by examiner

*Primary Examiner* — Lauren Crane
(74) *Attorney, Agent, or Firm* — Kyle A. Fletcher, Esq.

(57) ABSTRACT

The disposable sink cover is a hygienic cover that is adapted for use with a sink. The disposable sink cover is adapted for personal grooming use. The disposable sink cover is a water-impermeable sheeting that is placed over the sink. The disposable sink cover further comprises drain aperture. The drain aperture is an aperture that allows water to drain through the water impermeable sheeting into the sink. The drain aperture is lined with a mesh filter that removes the detritus resulting from the personal grooming activities. The disposable sink cover attaches to the sink with an adhesive. The disposable sink cover comprises a sheeting, a mesh, a mesh collar, and a plurality of adhesives. The mesh collar secures the mesh to the sheeting. The plurality of adhesives attaches the sheeting to the sink.

15 Claims, 5 Drawing Sheets

DISPOSABLE SINK COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including accessories for washstands, more specifically, a replaceable hygienic lining or casing for a wash basin.

SUMMARY OF INVENTION

The disposable sink cover is a hygienic cover that is adapted for use with a sink. The disposable sink cover is adapted for personal grooming use. The disposable sink cover is a water impermeable sheeting that is placed over the sink. The disposable sink cover further comprises a faucet aperture and a drain aperture. The faucet aperture is an aperture formed in the sheeting for the purpose of going around the faucet of the sink while the disposable sink cover is being placed over the sink. The drain aperture is an aperture that allows water to drain through the water impermeable sheeting into the sink. The drain aperture is lined with a mesh filter that removes the detritus resulting from the personal grooming activities. The disposable sink cover attaches to the sink with an adhesive.

These together with additional objects, features and advantages of the disposable sink cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the disposable sink cover in detail, it is to be understood that the disposable sink cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the disposable sink cover.

It is therefore important that the claims be regarded as including such equivalent construction insofar as they do not depart from the spirit and scope of the disposable sink cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
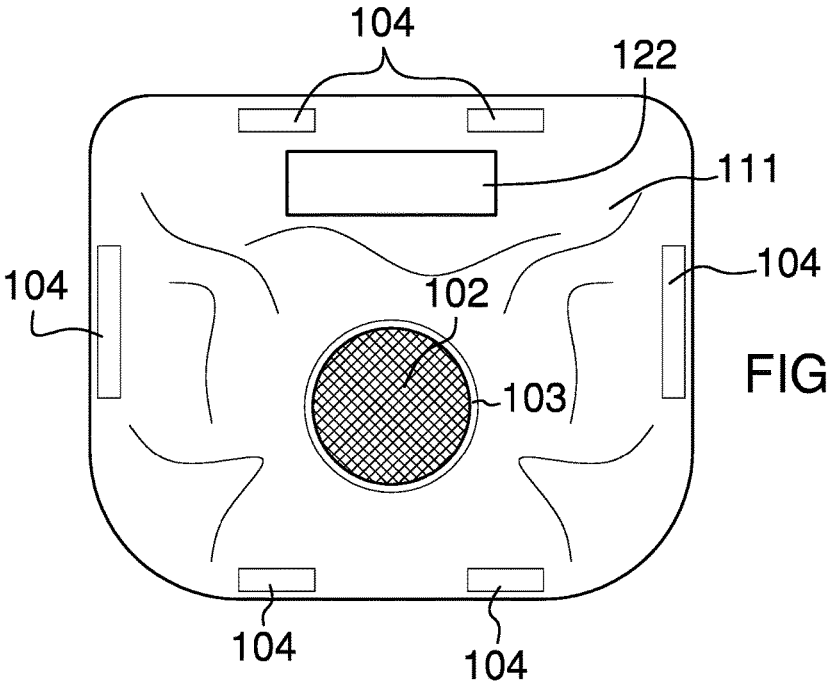
FIG. 1 is a top view of an embodiment of the disclosure.
Figure 2:
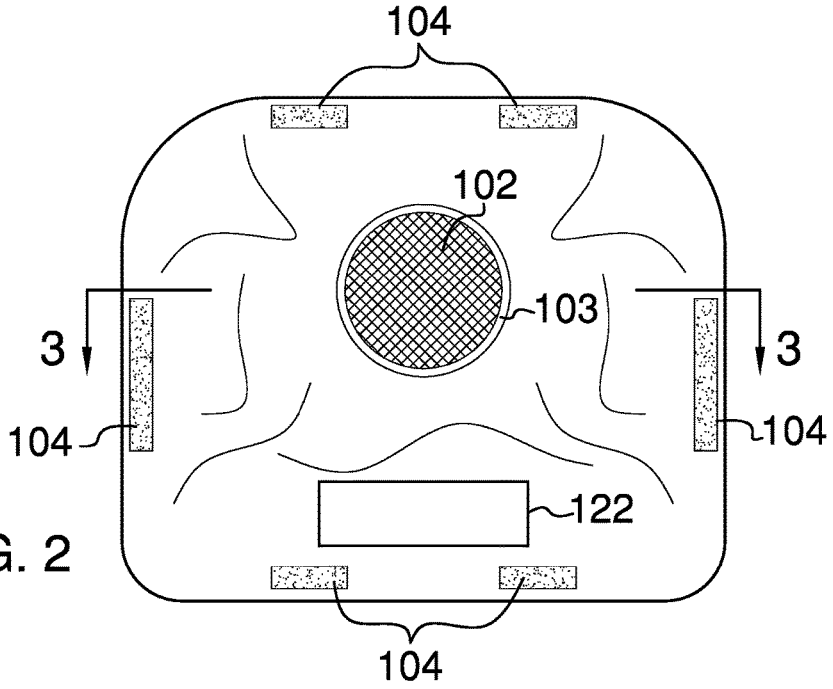
FIG. 2 is a bottom view of an embodiment of the disclosure.
Figure 3:
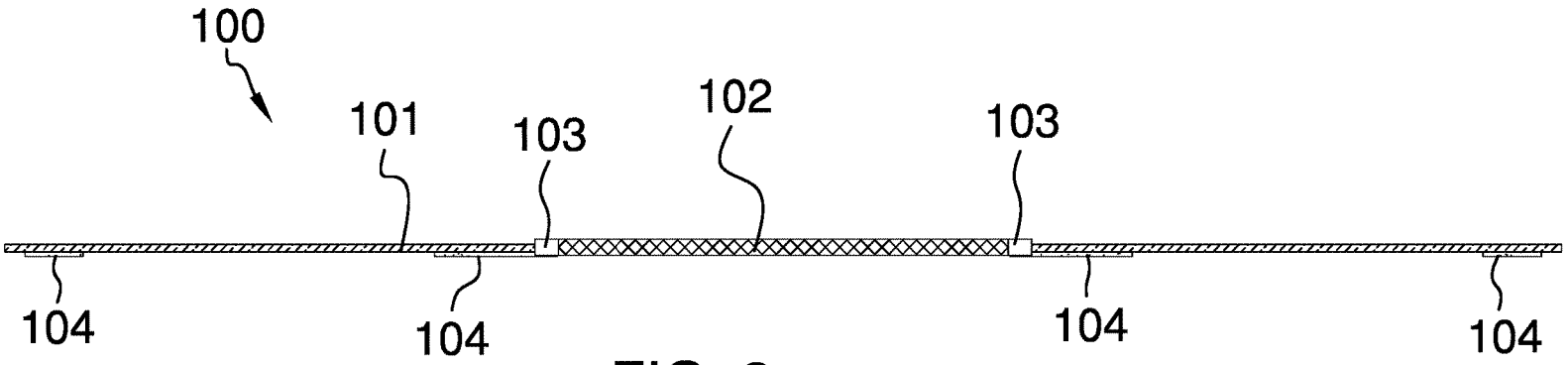
FIG. 3 is a cross-sectional view of an embodiment of the disclosure across 3-3 as shown in FIG. 2.
Figure 4:
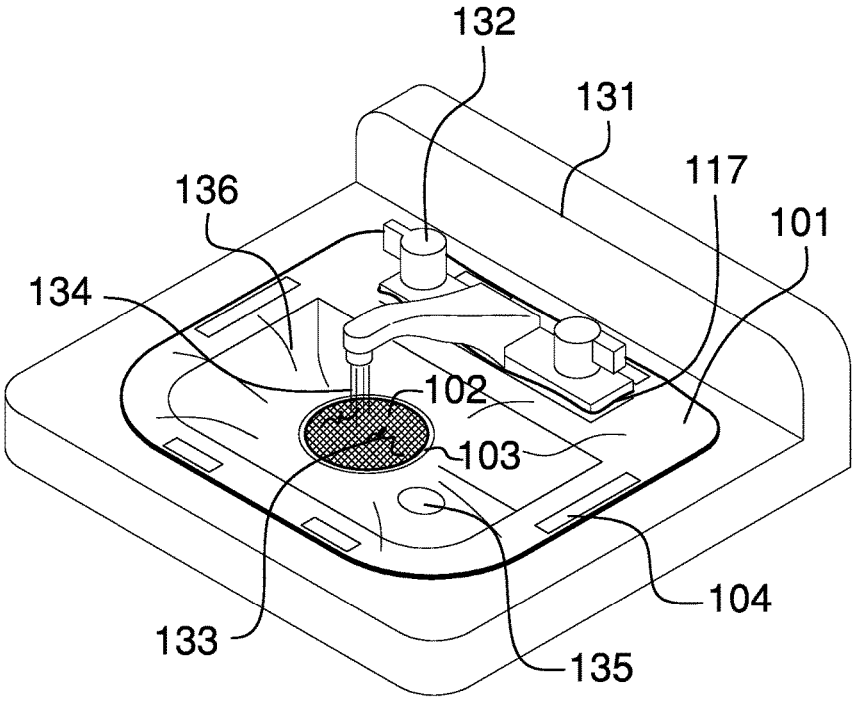
FIG. 4 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The disposable sink cover comprises a sheeting 101, a mesh 102, a mesh collar 103, and a plurality of adhesives 104. The mesh collar 103 secures the mesh 102 to the sheeting 101. The plurality of adhesives 104 attaches the sheeting 101 to a sink 131. The invention 100 is a hygienic cover that is adapted for use with a sink 131. The invention 100 is adapted for personal grooming use. The invention 100 is a water-impermeable sheeting 101 that is placed over the sink 131. The invention 100 further comprises a faucet aperture 122 and a drain aperture 121. The faucet aperture 122 is an aperture formed in the sheeting 101 for the purpose of going around the faucet 132 of the sink 131 while the invention 100 is being placed over the sink 131. The drain aperture 121 is a hole that allows water drain through the water impermeable sheeting 101 into the sink 131. The drain aperture 121 contains a mesh 102 that filters the detritus 133 resulting from the personal grooming activities before disposal of the waste water into the sink 131. The invention 100 attaches to the sink 131 with a plurality of adhesives 104.

The sheeting 101 is a water impermeable sheeting material. The sheeting 101 is formed from plastic and is further defined with a first side 141 and a second side 142. In the first potential embodiment of the disclosure, as shown most clearly in FIGS. 1 and 2, the sheeting 101 is cut in the shape of a rectangle with rounded corners which is generally suitable for all sinks 131. In alternate potential embodiments of the disclosure, the shape the sheeting 101 is cut in is customizable in the sense that the shape of the sheeting 101 can be adapted to more precisely fit the specific shape of a specific sink 131. The sheeting 101 further comprises a faucet aperture 122 and a drain aperture 121. The faucet aperture 122 is an aperture that is formed through the sheeting 101 for the purpose of passing the faucet 132 of the sink 131 through the sheeting 101 as it is applied to the sink 131. In the first potential embodiment of the disclosure, the faucet aperture 122 is formed in the shape of a rectangle. The faucet aperture 122 is cut in is customizable in the sense that the shape the faucet aperture 122 can be adapted to more precisely fit the specific shape of a specific sink 131. The drain aperture 121 is an aperture that is formed through the sheeting 101 for the purpose of passing the wastewater through the sheeting 101 into the sink 131. In the first potential embodiment of the disclosure, the drain aperture 121 is formed in a circular shape.

The mesh 102 is readily and commercially available screen mesh that is used to filter detritus 133 from the personal grooming water 134 that flows through the mesh 102 before the personal grooming water 134 drains through the drain aperture 121 into the sink 131. In the first potential embodiment of the disclosure, the mesh 102 is a wire screen mesh. The mesh 102 is cut in a circular shape to match the shape of the drain aperture 121.

Figure 5:
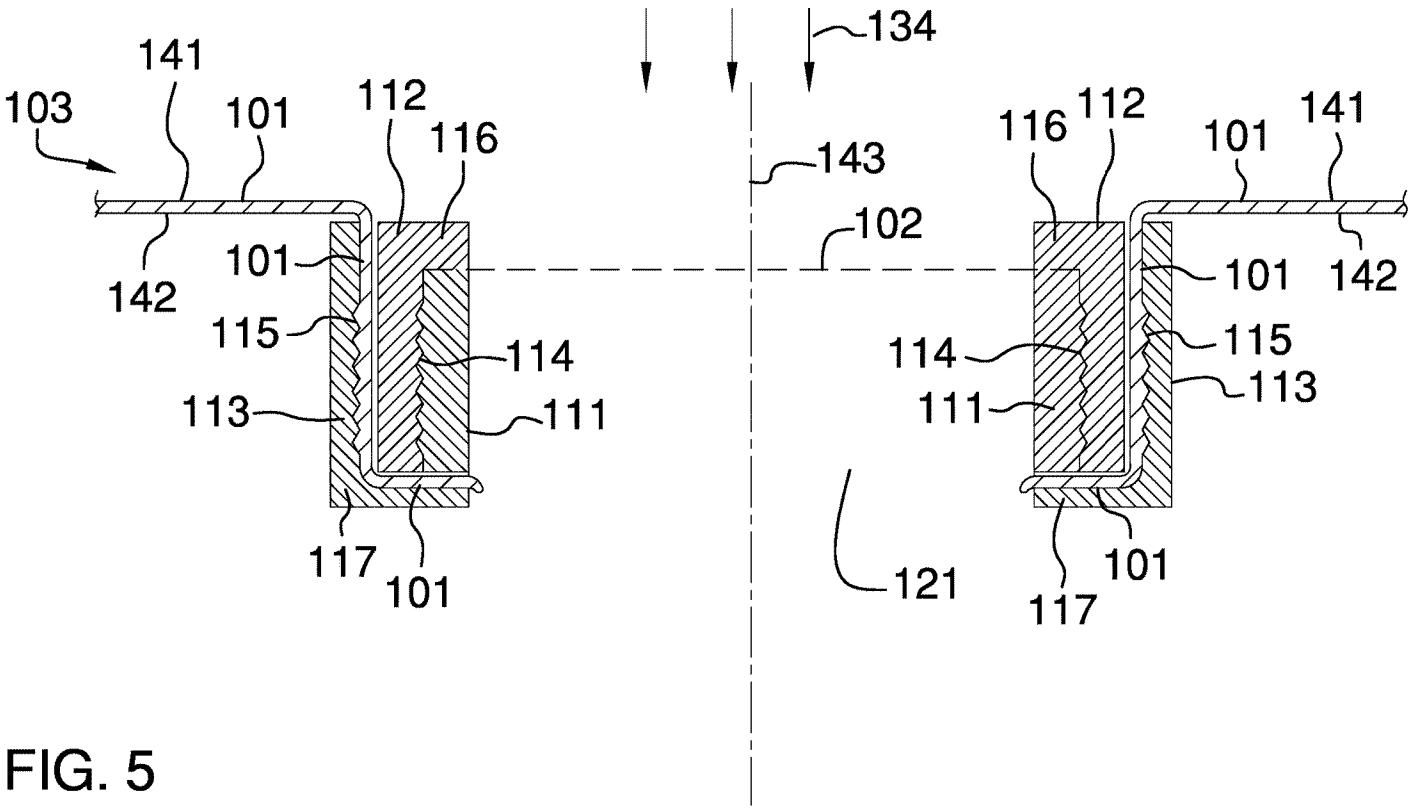
FIG. 5 is a detailed cross-sectional view of an embodiment of the disclosure across 5-5 as shown in FIG. 3.
Figure 6:
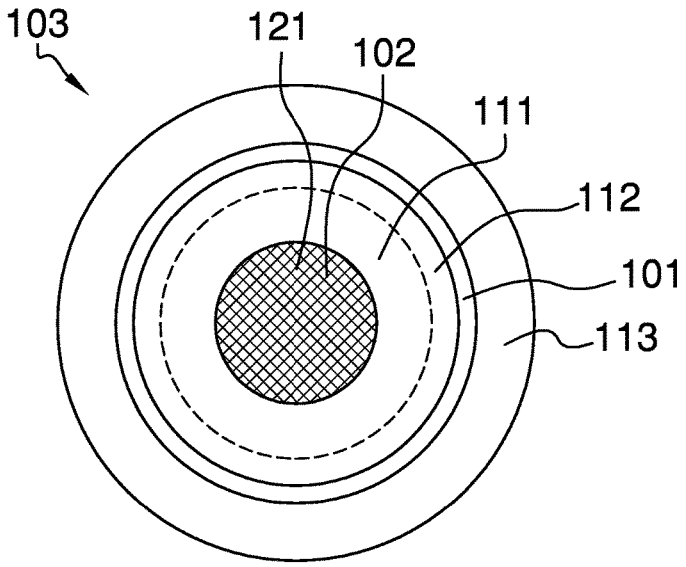
FIG. 6 is an end detail view of an embodiment of the disclosure.

As most clearly shown in FIGS. 5 and 6, the mesh collar 103 is a device that mounts the mesh 102 in the drain aperture 121. The mesh collar 103 is a grommet like device that is designed to: 1) hold the mesh 102 in position in over the drain aperture 121; in such a fashion that, 2) the mesh collar 103 prevents the sheeting 101 from tearing. The mesh collar 103 comprises an inner collar 111, a middle collar 112, and an outer collar 113. A first threaded connection 114 connects the inner collar 111 to the middle collar 112. A second threaded connection 115 connects the middle collar 112 to the outer collar 113. The inner collar 111 is a pipe like structure that is formed in the shape of a cylinder. The inner collar 111 is formed with the exterior screw thread associated with the first threaded connection 114. The middle collar 112 is a pipe like structure that is formed in the shape a cylinder. The middle collar 112 is further formed with the interior screw thread associated with the first threaded connection 114 and the exterior screw thread of the second threaded connection 115. The inner diameter of the middle collar 112 and the outer diameter of the inner collar 111 are sized such that the inner collar 111 will screw into the center of the middle collar 112 to form the first threaded connection 114. The outer collar 113 is a pipe like structure that is formed in the shape a cylinder. The outer collar 113 is further formed with the interior screw thread associated with the second threaded connection 115. The outer diameter of the middle collar 112 and the inner diameter of the outer collar 113 are sized such that the middle collar 112 will screw into the center of the outer collar 113 to form the second threaded connection 115.

When the mesh collar 103 is assembled as described above, the mesh collar 103 has a structure and properties similar that of a grommet. When the mesh collar 103 is installed into the sheeting 101, as described elsewhere in this disclosure, the mesh collar 103 will: 1) form the drain aperture 121 through the sheeting 101; 2) secure the mesh 102 over the drain aperture 121; and 3) reduce the strains and reinforce the perimeter of the sheeting 101 for the purpose of preventing tears in the sheeting 101 during invention 100 use.

The middle collar 112 has further formed in it a first flange 116. As shown most clearly in FIG. 5, the first flange 116 is a flat rim that is formed in an end of the middle collar 112 such that the first flange 116 perpendicularly projects towards the center axis 143 of the middle collar 112. The purpose of the first flange 116 is to provide a ledge upon which the mesh 102 can be placed. The mesh 102 is then locked into place by screwing the inner collar 111 into the middle collar 112. The depth of the span of the first flange 116 towards the center axis 143 is sized such that the personal grooming water 134 will flow freely through the mesh collar 103.

The outer collar 113 has further formed in it a second flange 117. As shown most clearly in FIG. 5, the second flange 117 is a flat rim that is formed in an end of the outer collar 113 such that the second flange 117 perpendicularly projects towards the center axis 143 of the outer collar 113. The purpose of the second flange 117 is to secure the sheeting 101 to the mesh collar 103. The depth of the span of the second flange 117 towards the center axis 143 is sized such that the personal grooming water 134 will flow freely through the mesh collar 103.

Once the mesh 102 is inserted into the mesh collar 103, as described elsewhere in this disclosure, the mesh collar 103 can be attached to the sheeting 101 as follows. The end of the middle collar 112 that is distal from the first flange 116 is pressed into the first side 141 of the sheeting 101 such that the first sheeting 101 wraps around the exterior face of the middle collar 112. The middle collar 112 is then screwed into the outer collar 113 such that the second side 142 of the sheeting 101 is proximal to the inner face of the outer collar 113. As shown in FIG. 5, the middle collar 112 is screwed into the outer collar 113 until the middle collar 112 presses against the second flange 117. The force between the middle collar 112 and the second flange 117 holds the sheeting 101 in position. Once the sheeting 101 is secured in position, a circular segment is cut out of the sheeting 101 such that the diameter of the circular segment is greater than or equal to the inner diameter of the inner collar 111.

The plurality of adhesives 104 is applied to second side 142 of the sheeting 101. The plurality of adhesives 104 is applied such that the plurality of adhesives 104 will attach the invention 100 to the sink 131 during invention 100 use. The adhesive with relatively low bonding strength is preferred such that the invention 100 can be readily removed from the sink 131 after use. In the first potential embodiment of the disclosure, a commercially available double-sided adhesive tape is used.

To use the invention 100, the second side 142 of the sheeting 101 is attached to the sink 131 such that the sheeting 101 covers the sink basin 136. It is preferred that the drain aperture 121 be placed directly over the sink drain 135. When personal grooming is completed, the invention 100 is disposed of with the domestic waste.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two-cylinder or like structures share the same line they are said to be aligned. When the center axes of two-cylinder like structures do not share the same line they are said to be offset.

Collar: As used in this disclosure, a collar is a ring like device that secures an object in a position.

Detritus: As used in this disclosure, detritus refers to fragments, shavings or other solid waste products resulting from a mechanical procedure.

Exterior: As used in this disclosure, the exterior is use as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Flange: As used in this disclosure, a flange is a protruding rib, edge, or collar that is used to hold an object in place or to attach a first object to a second object.

Grommet: As used in this disclosure, a grommet is an eyelet placed in a hole in a textile, sheet, or panel that protects a rope hook or cable passed through it and to protect the textile, sheet, or panel from being torn.

Inner Diameter: As used in this disclosure, the term inner diameter is used in the same way that a plumber would refer to the inner diameter of a pipe.

Interior: As used in this disclosure, the interior is use as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Perimeter: As used in this disclosure, a perimeter is one or more curved or straight lines that surrounds an enclosed area on a plane or surface. The perimeter of a circle is commonly referred to as a circumference.

Outer Diameter: As used in this disclosure, the term outer diameter is used in the same way that a plumber would refer to the outer diameter of a pipe.

Rim: As used in this disclosure, a rim is an outer edge or border that follows along the perimeter of an object.

Sheeting: As used in this disclosure, sheeting is a material, such as cloth or plastic, in the form of a thin flexible layer or layers.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hygienic lining comprising:

a sheeting, a mesh, a mesh collar, and a plurality of adhesives;

wherein the hygienic lining is a cover that is adapted for use with a sink;

wherein the hygienic lining is adapted for personal grooming use;

wherein the hygienic lining is adapted for use with personal grooming waste water;

wherein the mesh collar secures the mesh to the sheeting;

wherein the plurality of adhesives attaches the sheeting to the sink;

wherein the mesh collar secures the mesh to the sheeting;

wherein the sheeting is a water impermeable sheeting material;

wherein the sheeting is further defined with a first side and a second side;

wherein the sheeting further comprises the faucet aperture and the drain aperture;

wherein the faucet aperture is a second aperture that is formed through the sheeting;

wherein the drain aperture is a first aperture that is formed through the sheeting;

wherein the personal grooming waste water passes through the drain aperture into the sink;

wherein the mesh is a screen mesh;

wherein the mesh is positioned at the drain aperture;

wherein the mesh collar secures the mesh in position in over the drain aperture;

wherein the mesh collar prevents the sheeting from tearing;

wherein the mesh collar comprises an inner collar, a middle collar, and an outer collar;

wherein a first threaded connection connects the inner collar to the middle collar;

wherein a second threaded connection connects the middle collar to the outer collar.

2. The hygienic lining according to claim 1 wherein the inner collar is a pipe that is formed in the shape of a first cylinder;

wherein the inner collar is formed with a first exterior screw thread associated with the first threaded connection.

3. The hygienic lining according to claim 2
wherein the middle collar is a pipe that is formed in the shape a second cylinder;
wherein the middle collar is further formed with a first interior screw thread associated with the first threaded connection;
wherein the middle collar is further formed with a second exterior screw thread associated with the second threaded connection;
wherein the inner collar screws into the center of the middle collar to form the first threaded connection.

4. The hygienic lining according to claim 3
wherein the outer collar is a pipe that is formed in the shape a cylinder;
wherein the outer collar is further formed with a second interior screw thread associated with the second threaded connection;
wherein the middle collar screws into the center of the outer collar to form the second threaded connection.

5. The hygienic lining according to claim 4
wherein the middle collar has further formed in it a first flange;
wherein the first flange is a first flat rim that is formed in a first end of the middle collar;
wherein the first flange perpendicularly projects towards the center axis of the middle collar.

6. The hygienic lining according to claim 5
wherein the depth of the span of the first flange towards the center axis is sized such that the personal grooming water flows through the mesh collar.

7. The hygienic lining according to claim 6
wherein the mesh is placed on the first flange;
wherein the mesh is then locked into place by screwing the inner collar into the middle collar.

8. The hygienic lining according to claim 7
wherein the outer collar has further formed in it a second flange;
wherein the second flange is a second flat rim that is formed in a second end of the outer collar;
wherein the second flange perpendicularly projects towards the center axis of the outer collar.

9. The hygienic lining according to claim 8
wherein the depth of the span of the second flange towards the center axis is sized such that the personal grooming water flows through the mesh collar.

10. The hygienic lining according to claim 9
wherein the second flange secures the sheeting to the mesh collar;
wherein the end of the middle collar that is distal from the first flange is pressed into the first side of the sheeting such that the first sheeting wraps around the exterior face of the middle collar;
wherein the middle collar is screwed into the outer collar such that the second side of the sheeting is proximal to the inner face of the outer collar;
wherein the middle collar is screwed into the outer collar until the middle collar presses against the second flange;
wherein a segment is cut out of the sheeting to form the first aperture such that the personal grooming water flows through the mesh collar.

11. The hygienic lining according to claim 10
wherein the plurality of adhesives are applied to second side of the sheeting.

12. The hygienic lining according to claim 11 wherein
the first aperture is a circular segment;
wherein the diameter of the circular segment is greater than or equal to the inner diameter of the inner collar.

13. The hygienic lining according to claim 12 wherein in the mesh is formed from metal wire.

14. The hygienic lining according to claim 13 wherein the sheeting is cut in the shape of a rectangle with rounded corners.

15. The hygienic lining according to claim 14 wherein each of the plurality of adhesives is a double-sided adhesive tape.

* * * * *